US006109948A

United States Patent [19]

Kuo

[11] Patent Number: 6,109,948

[45] Date of Patent: Aug. 29, 2000

[54] LOCKING DEVICE FOR COUPLING TWO MATING ELECTRICAL CONNECTORS TOGETHER

[75] Inventor: Peter Kuo, Chung-Ho, Taiwan

[73] Assignee: Hon Hai Precision Ind. Co., Ltd., Taipei Hsien, Taiwan

[21] Appl. No.: 09/364,172

[22] Filed: Jul. 29, 1999

[30] Foreign Application Priority Data

Mar. 30, 1999 [TW] Taiwan ..... 88204825

[51] Int. Cl.[7] ..... H01R 13/627

[52] U.S. Cl. ..... 439/357

[58] Field of Search ..... 439/350–358

[56] References Cited

U.S. PATENT DOCUMENTS 4,778,411 10/1988 Rudy, Jr. et al. ..... 439/358

5,462,448 10/1995 Kida et al. ..... 439/357

5,741,150 4/1998 Stinson et al. ..... 439/358

5,775,931 7/1998 Jones ..... 439/358

*Primary Examiner*—Gary F. Paumen

*Attorney, Agent, or Firm*—Wei Te Chung

[57] ABSTRACT

A locking device for securing first and second electrical connectors together comprises a first member and a second member. The first member comprises a mounting post received in the first connector and a spherical head extending beyond the first connector. The second member comprises a retention portion secured in the second connector and a spring arm having an engaging portion. The engaging portion is semi-bowl shaped to adapt for engaging with the head. When the first and second connectors are mated together, the head engages the engaging portion with at least a rear portion thereof abutting against a free edge of the engaging portion thereby establishing reliable engagement between the head and the engaging portion.

4 Claims, 7 Drawing Sheets

LOCKING DEVICE FOR COUPLING TWO MATING ELECTRICAL CONNECTORS TOGETHER

BACKGROUND OF THE INVENTION

The present invention relates to a locking device for coupling two mating connectors together, and particularly to a locking device comprising a pair of male members and a pair of female members resiliently engaged together.

The electrical connection between two mated, separable connectors is often adversely affected by conditions such as vibration or an unexpected external force. In order to protect the connection from such disturbances, separable connectors often have engageable locking devices for securing the two mated connectors together. U.S. Pat. No. 5,401,189 and Taiwan Patent Application Nos. 83207804 and 84201383 disclose such connectors.

Referring to FIG. 1, a conventional connector 100 comprises a dielectric housing 101, a plurality of conductive contacts 102 received in the housing 101, upper and lower covers 103, 104, and a pair of locking members 105 assembled on opposite sides of the covers 103, 104. Each locking member 105 is manufactured from wire bent several times to form a clasp 106. The locking member 105 is pivotably engaged with engaging portions 107 formed on the housing 101. A mated connector 10 provides a pair of projections 12 each defining a cutout 13 for engaging with the locking member 105. After the connectors 10, 100 are mated together, the locking member 105 is pivoted toward the mated connector 10 until the clasp 106 thereof is received in the cutout 13 of the connector 10 thereby securing the connectors 100, 10 together.

However, the locking member 105 occupies a significant amount of transverse space when disposed an unsecured state. Thus, such a design does not promote conservation of space, particularly when a plurality of connectors is mated to mating connectors compactly mounted on an unitary base. In addition, when the connectors 10, 100 are mated together, the locking member 105 is not automatically coupled with the cutout 103 of the connector 10. A manual operation is required thereby complicating the mating operation. Hence, an improved electrical connector is required to overcome the disadvantages of the prior art.

BRIEF SUMMARY OF THE INVENTION

A first object of the present invention is to provide a locking device for securing two mated connectors together, comprising two members automatically engaging with each other when the two mated connectors are mated together.

A second object of the present invention is to provide a locking device which performs simple locking and unlocking operations.

Accordingly, a locking device for securing first and second electrical connectors together comprises a male member having a mounting post received in the first connector and a spherical head extending beyond the first connector, and a female member having a spring arm received in the second connector and a engaging portion having a concave surface. The concave surface corresponds to the head. The engaging portion spans an angle of approximately 100 to 130 degrees in an elongate direction of the female member. A free edge of the engaging portion forms a bevel for facilitating insertion of the head therein. The spherical head comprises a front portion and a rear portion divided by the greatest cross section thereof perpendicular to an axis of the male member.

When the first and second connectors are mated together, the head is received in the engaging portion with at least the rear portion thereof abutting against a free edge of the engaging portion, thereby preventing rear movement of the male member. Thus, reliable engagement between the head and the engaging portion is established.

Other objects, advantages and novel features of the invention will become more apparent from the following detailed description of the present embodiment when taken in conjunction with the accompanying drawings.

DETAILED DESCRIPTION OF THE INVENTION

Figure 1:
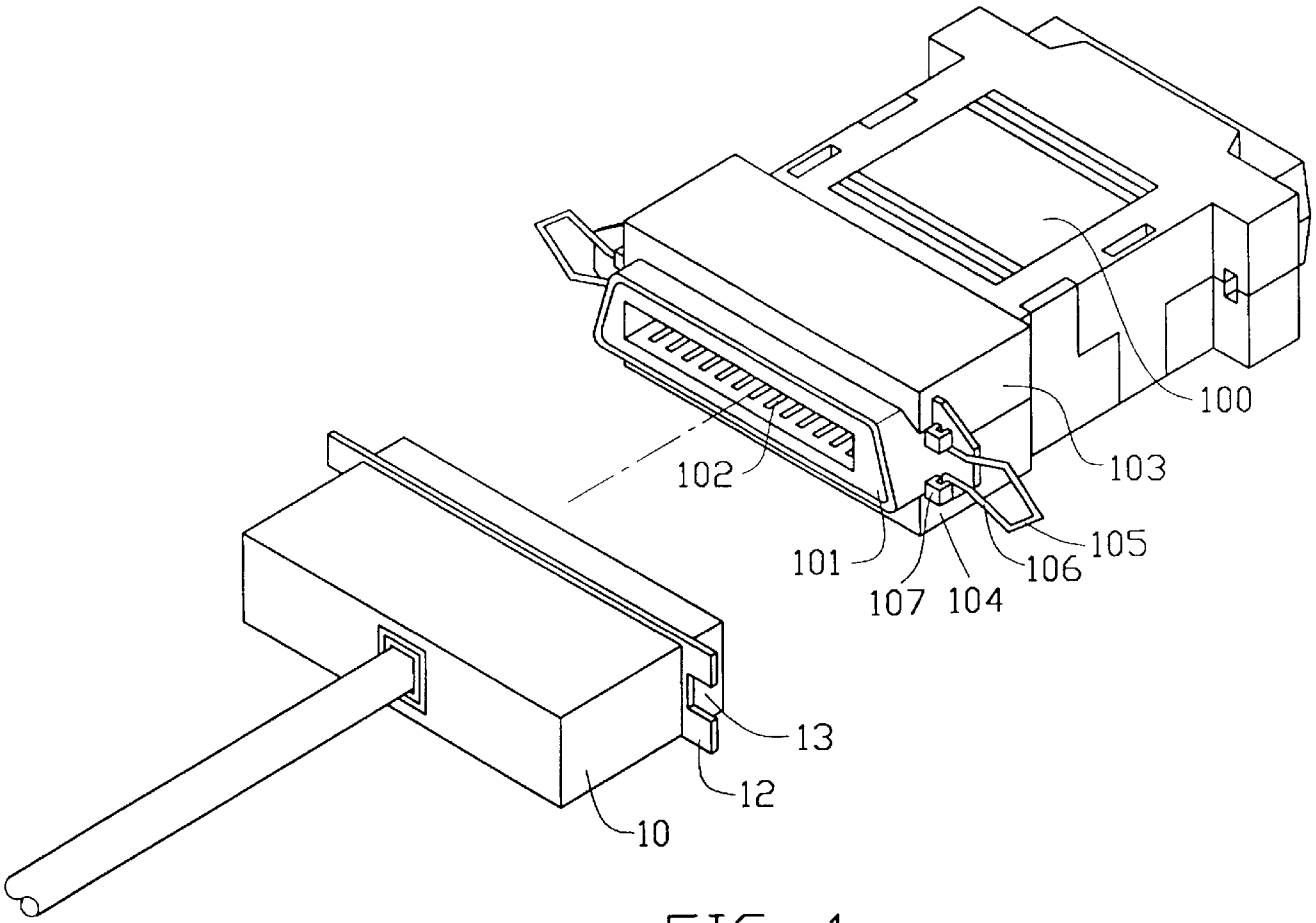
FIG. 1 (PRIOR ART)
FIG. 1 is a perspective view of two mated connectors having conventional locking members.
Figure 2:
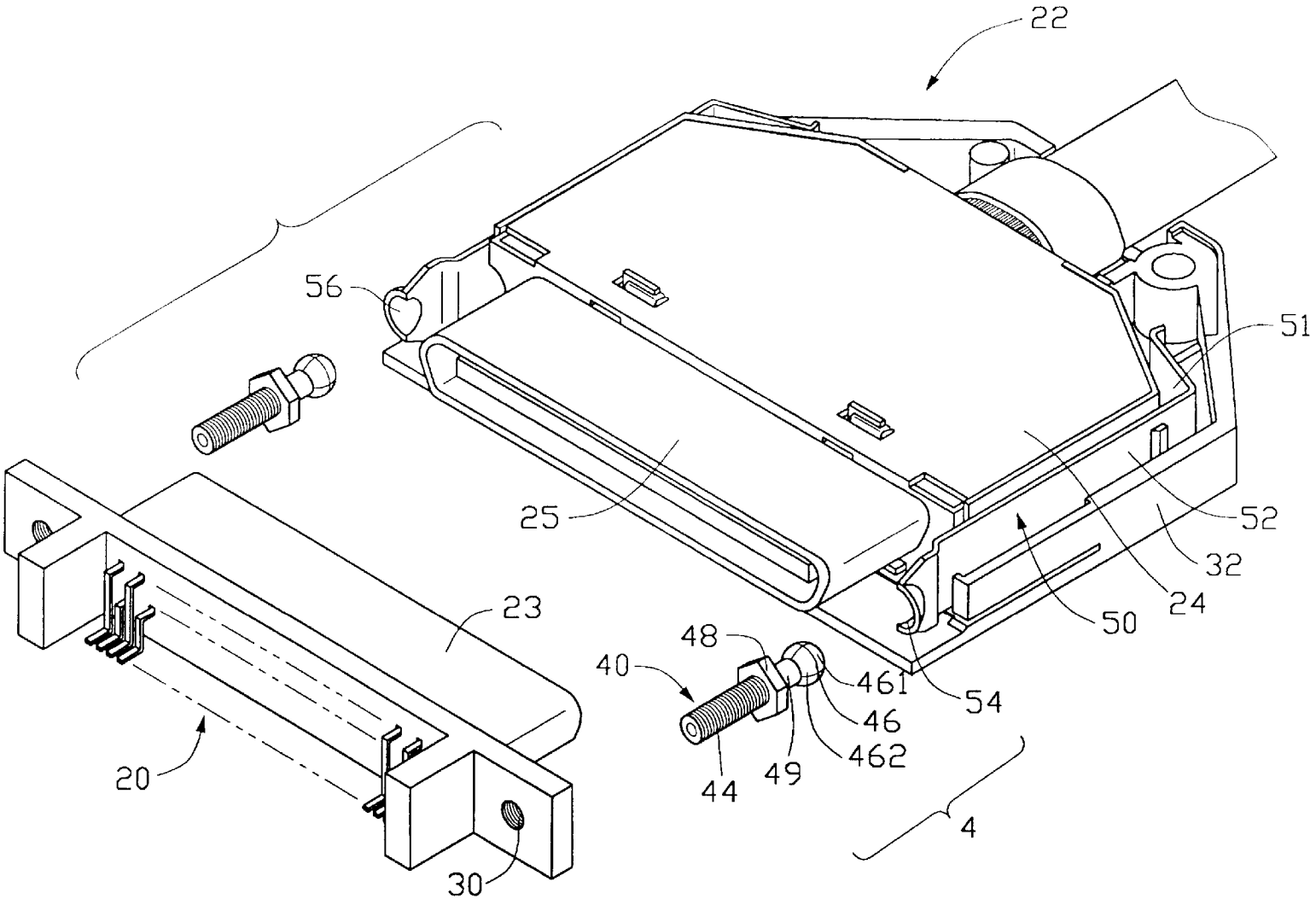
FIG. 2 is a perspective view of first and second connectors with a top cover removed from the first connector to show a pair of locking devices of the present invention.
Figure 3:
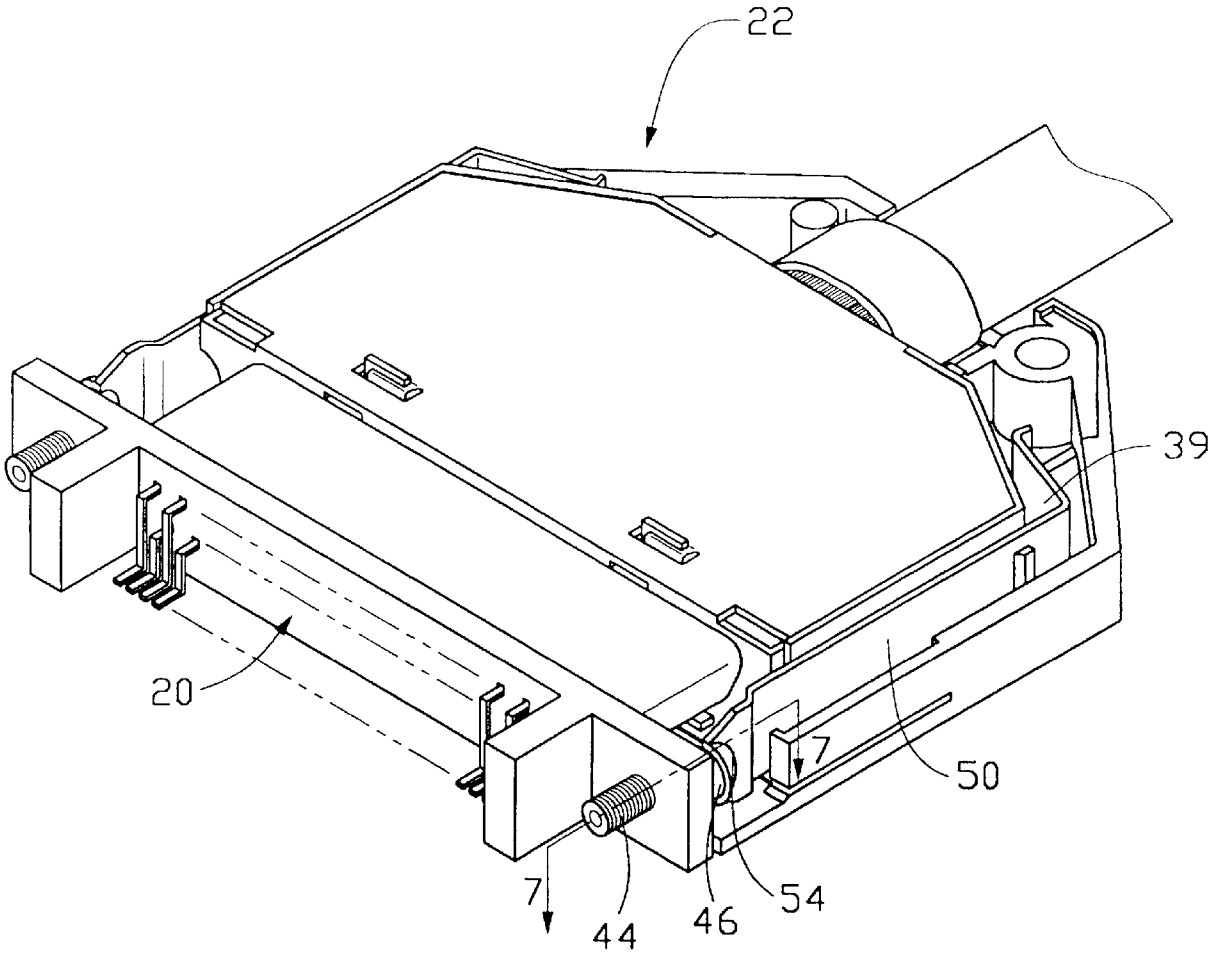
FIG. 3 is a view similar to FIG. 2 but showing the first and second connectors at an engaged state.

Referring to FIGS. 2 and 3, a locking device 4 for securing first and second electrical connectors 22, 20 together comprises a female member 50 and a male member 40 respectively received in the first and second connectors 22, 20. The first connector 22 comprises a unitary housing 24 having a first mating portion 25 receiving a plurality of contacts (not shown), a bottom cover 32 and a top cover (not shown). The housing 24 is disposed in the bottom cover 32 with opposite sides thereof positioned proximate corresponding sides of the bottom cover 32. The second connector 20 comprises a second engaging portion 23 receiving a plurality of terminals for mating with the first engaging portion 25 of the first connector 22. The second connector 20 defines a pair of screw holes 30 in opposite ends thereof.

The male member 40 comprises a threaded mounting post 44 and a spherical head 46. The mounting post 44 is threadedly received in the screw hole 30 of the second connector 20. The spherical head 46 comprises a front portion 461 and a rear portion 462 divided by a line "C" (FIG. 7) corresponding to a diameter of the spherical head 46 and being perpendicular to an axis of the male member 40. The male member 40 has a hexagonal plate 48 between the mounting post 44 and the head 46 for screwing the mounting post 44 into the screw hole 30 of the first connector 20. A neck 49 is provided between the hexagonal plate 48 and the head 46 for facilitating manufacture of the male member 40.

Figure 7:
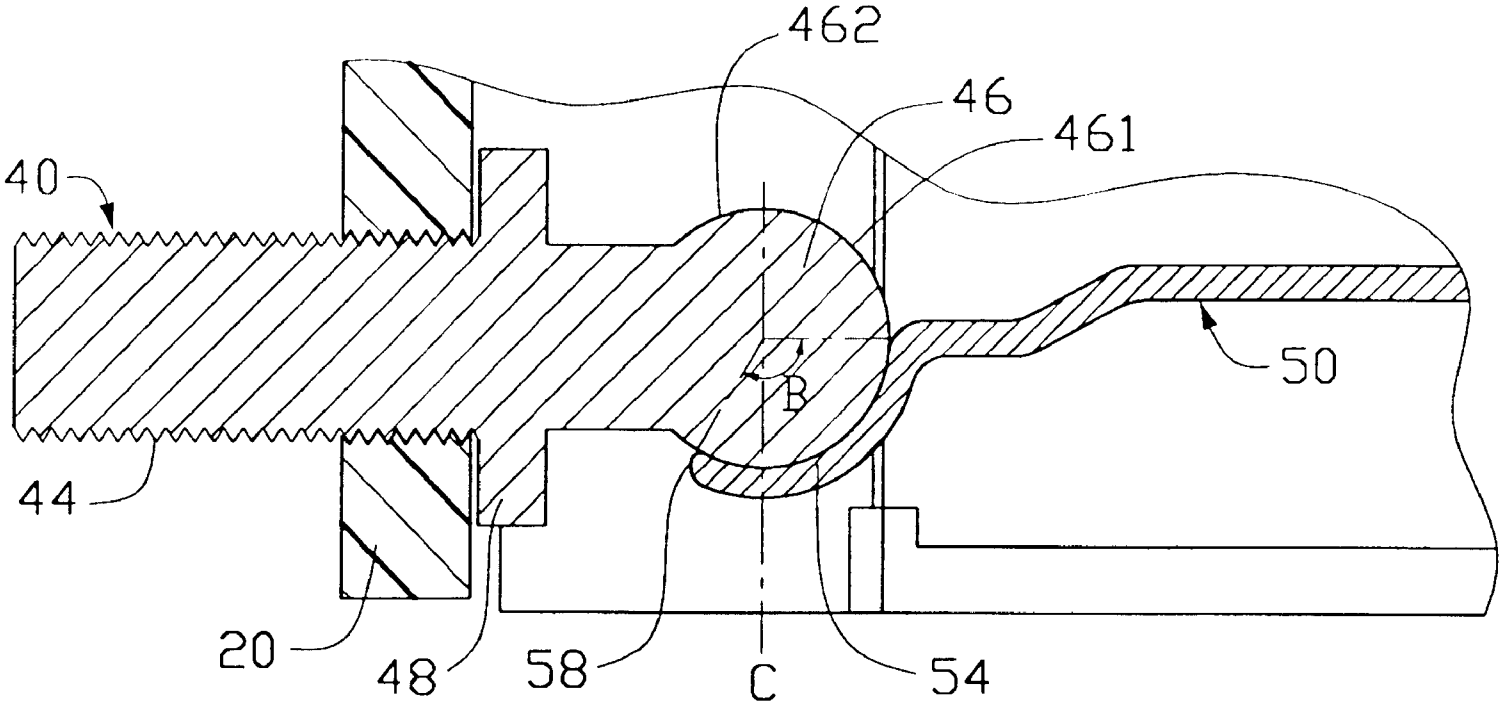
FIG. 7 is a cross-sectional view taken along line 7—7 of FIG. 3.

Also referring to FIG. 7, the female member 50 comprises a retention portion 51 secured in the second connector 22 and a spring arm 52 received between the housing 24 and the bottom cover 32. The spring arm 52 forms an engaging portion 54 having a chamber 56 for engaging with the head 46. The engaging portion 54 is semi-bowl shaped and spans an angle of approximately 100 to 130 degrees in a plane connecting the pair of female members 50 to properly retain the head 46 with at least a free edge of the engaging portion 54 abutting against the rear portion 462 of the head 46. Thus, movement of the male member 40 away from the female member 50 in the direction of arrow "A" (FIG. 2) is prevented. The engaging portion 54 forms a bevel 58 on the free edge thereof for facilitating insertion of the head 46 therein.

Figure 4:
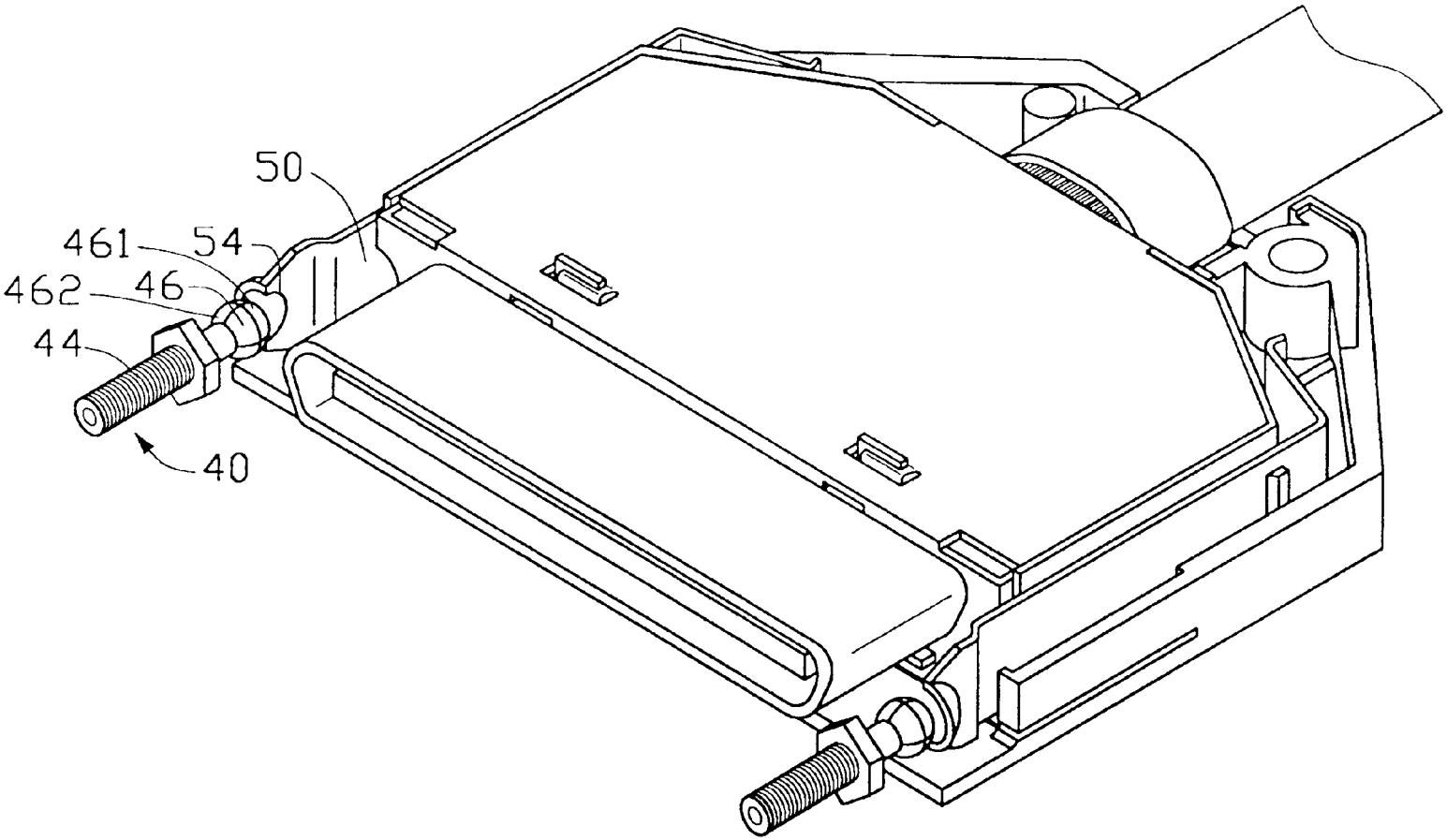
FIGS. 4, 5 and 6 are perspective views of the first connector and the locking device with the top cover of the first connector removed therefrom to show successive processes of engagement between two members of the locking device.
Figure 5:
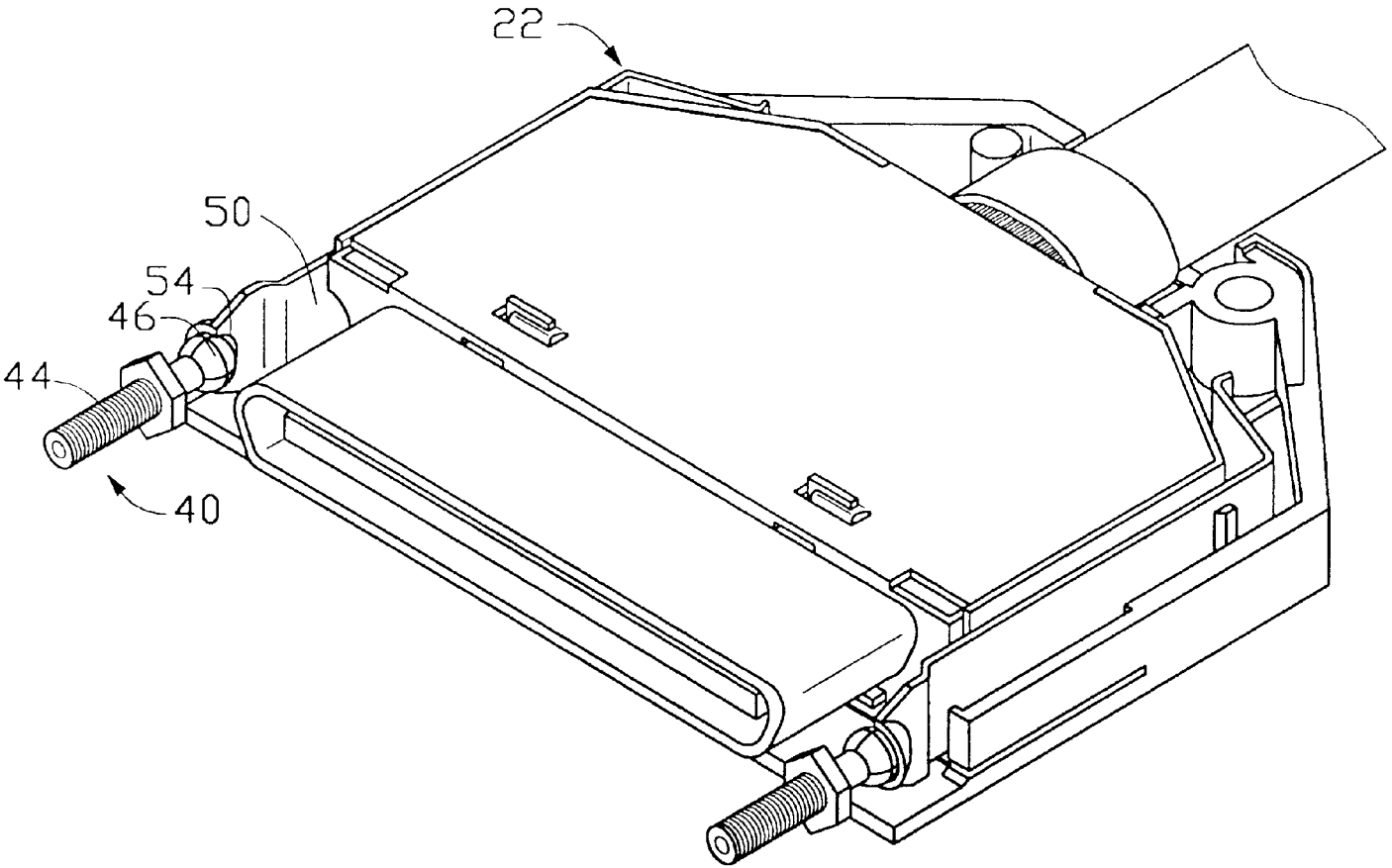
Figure 6:
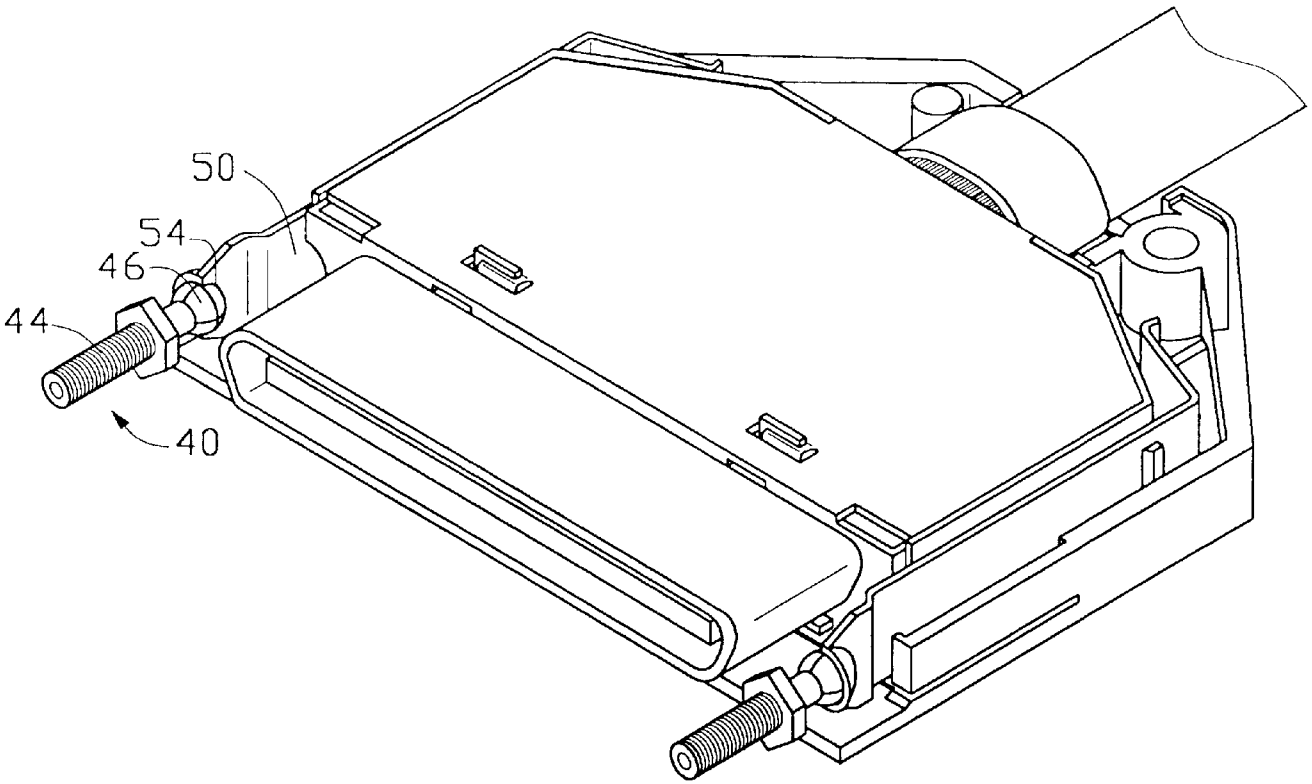

Also referring to FIGS. 4, 5 and 6, when the connector 20 is mated to the connector 22, the male member 40 moves toward the female member 50. The front portion 461 of the head 46 abuts against the bevel 58 of the engaging portion 54 and causes the engaging portion 54 to deflect outwardly. The engaging portion 54 further deflects outwardly until the free edge thereof abuts a portion of the head 46 having the vertical diameter (i.e., a place through which line "C" extends). The engaging portion 54 then moves inwardly to and the head 46 is reliably received in the chamber 56 thereof to prevent the male member 40 disengaging with the female member 50.

When the connector 20 is disengaged from the connector 22, the male member 40 moves away from the female member 50. The rear portion 462 of the head 46 abuts against the free edge of the engaging portion 54 and causes the engaging portion 54 to deflect outwardly until the free edge of the engaging portion 54 abuts against the portion having the vertical diameter of the head 46 (i.e., a place through which line "C" extends). The engaging portion 54 then moves inwardly to push the head 46 away therefrom.

Referring to FIG. 7, an angle of "B" formed between a center of the spherical head 46 and a free end point and a base point of the engaging portion 54 is between 100 and 130 degrees whereby the free end of the engaging portion 54 abuts against the rear portion 462 of the head 46 to prevent the male member 40 from disengaging from the female member 50 in the direction of arrow "A" (FIG. 2). Understandably, under this situation the engagement portion 54 covers over one fourth area of the surface of the head 46.

It is to be understood, however, that even though numerous characteristics and advantages of the present invention have been set forth in the foregoing description, together with details of the structure and function of the invention, the disclosure is illustrative only, and changes may be made in detail, especially in matters of shape, size, and arrangement of parts within the principles of the invention to the full extent indicated by the broad general meaning of the terms in which the appended claims are expressed.

What is claimed is:

1. A locking device for securing first and second electrical connectors together, comprising:

a pair of first members each having a mounting post secured in the first connector and a head extending from the mounting post; and a pair of second members each having a retention portion secured in the second connector and a spring arm extending from the retention portion, each spring arm resiliently abutting against a periphery of associated head in opposite directions to securely engage the first members with the second members;

wherein the spring arm of each second member forms an engaging portion at a free end thereof, the engaging portion defining a chamber for receiving the head of each first member;

wherein the head is spherical and the engaging portion of each spring arm has a shape adapted for engaging with the head;

wherein the engaging portion of each spring arm comprises a semi-bowl shaped portion;

wherein the engaging portion of each spring arm spans an angle of approximately 100 to 130 degrees in a plane containing the two second members and the head comprises a front portion and a rear portion, the engaging portion bearing against at least the rear portion to prevent the head from disengaging from the engaging portion.

2. The locking device as claimed in claim 1, wherein the mounting post is externally threaded and wherein a hexagonal plate is provided between the mounting post and the head of the first member for facilitating screwing the mounting post into a screw hole of the first connector.

3. The locking device as claimed in claim 2, wherein a neck is provided between the hexagonal plate and the head of the first member for facilitating manufacture of the first member.

4. A connector assembly comprising:

a first connector and a second connector face to face assembled together;

a pair of first members each having a spherical head extending forward on either side of the first connector; and a pair of second members each having a spring arm with a bowl type engagement portion at the distal end and extending forward on either side of the second connector; wherein when assembled, the engagement portion of each of the second members covers more than one fourth area of a surface of the engaged spherical head of the corresponding first member.

* * * * *